US005282658A

United States Patent [19]

Reeves, Jr.

[11] Patent Number: 5,282,658

[45] Date of Patent: Feb. 1, 1994

[54] PIVOTALLY MOUNTED DOOR STOP DEVICE

[76] Inventor: Lewis W. Reeves, Jr., 7421 Belle River Ct., Winter Park, Fla. 32792

[21] Appl. No.: 970,056

[22] Filed: Nov. 2, 1992

[51] Int. Cl.[5] ..... E05C 17/44

[52] U.S. Cl. ..... 292/338; 292/DIG. 15

[58] Field of Search ..... 292/63, 67, 338, 339, 292/DIG. 15, DIG. 49

[56] References Cited

U.S. PATENT DOCUMENTS

| | | | |
|---|---|---|---|
| 921,020 | 5/1190 | Spencer | 292/338 |
| 1,054,151 | 2/1913 | Troetel | 292/338 |
| 1,566,805 | 12/1925 | Ackerman | 292/338 |
| 1,602,226 | 10/1926 | Gully | 292/338 |
| 1,624,836 | 4/1927 | Hickie | 292/DIG. 15 X |
| 1,631,980 | 6/1927 | Piccirilli | 292/DIG. 15 X |
| 2,168,635 | 8/1939 | Wallace | 292/338 |
| 2,527,278 | 10/1950 | Schemansky | 292/338 X |
| 2,704,220 | 3/1955 | Graham | 292/DIG. 15 X |
| 3,129,969 | 4/1964 | Kuo | 292/DIG. 15 X |
| 3,731,341 | 5/1973 | Woodruff | 292/DIG. 15 X |

*Primary Examiner*—Richard E. Moore
*Attorney, Agent, or Firm*—Julian C. Renfro

[57] ABSTRACT

A door stop adapted for a mounting adjacent a lower edge of a door at a location remote from the hinge, such door stop functioning to prevent an intruder from pushing the door open. This door stop comprises a mounting device adapted to be secured in a fixed position adjacent the lower edge of the door, and an elongate, rigid member operatively associated with the mounting device. One end of the elongate, rigid member has an aperture, enabling it to be pivotally mounted to the mounting device, and the other end of the elongate, rigid member has a component adapted to move, at the behest of the user, into contact with the floor. The elongate member is selectively movable between a raised, substantially vertical storage position residing close to the door, and an active, downwardly angled position in which the other end is in firm contact with the floor. I advantageously utilize a spring bias arrangement serving to hold the other end of the elongate member in such position of firm contact with the floor.

10 Claims, 2 Drawing Sheets

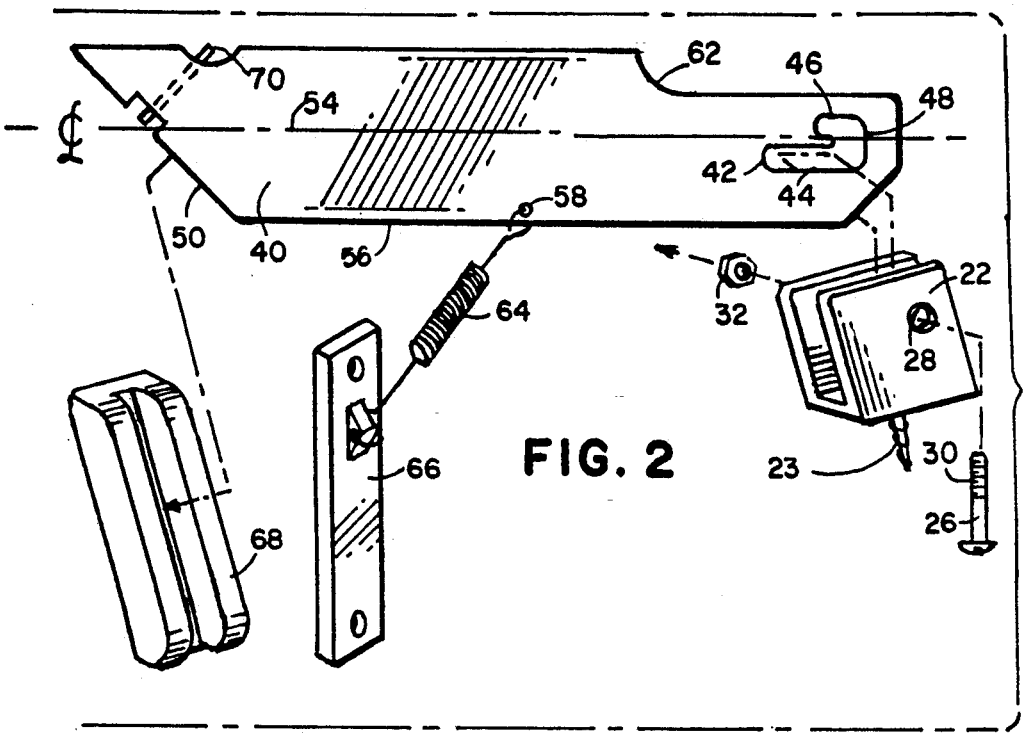
FIG. 2
FIG. 5
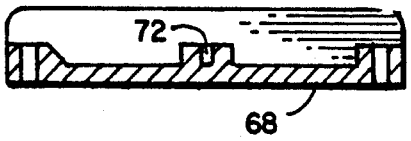
FIG. 4
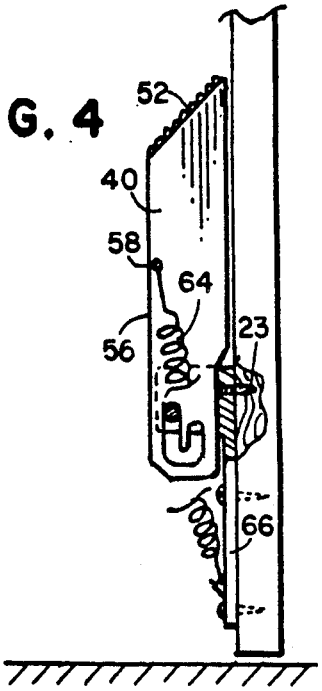
FIG. 3
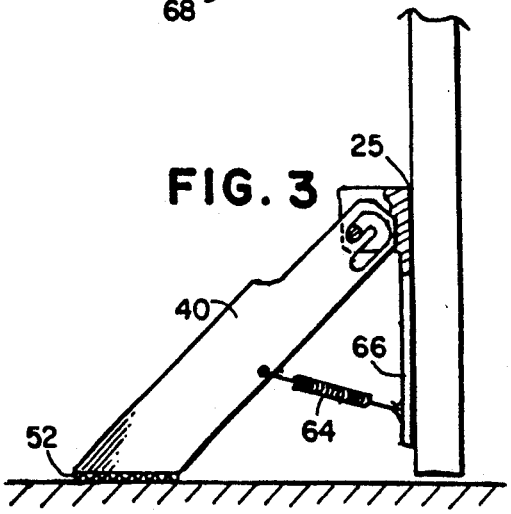

PIVOTALLY MOUNTED DOOR STOP DEVICE

BACKGROUND OF THE INVENTION

Many doors, both interior doors as well as exterior doors, are not equipped with satisfactory locking means. Accordingly, many travelers stayinq overnight in certain hotels and motels resort to the use of certain door-blocking devices that will provide more security against unauthorized entry. Such door-blocking devices can include the use of a rigid chair wedged under the door knob, a heavy piece of furniture placed against the door, or a type of cable looped over the door handle and affixed to the door casing.

There is a distinct need for a relatively simple, but highly effective door-blocking device for use in conjunction with doors having an insufficient locking arrangement, such a door blocker should be of sturdy construction, be readily installed, be of a configuration that can be readily transported, and be affordable.

It is the purpose of this invention to provide such a device.

SUMMARY OF THE INVENTION

A door stop adapted for mounting on a lower edge of a door in order to prevent an intruder from pushing the door open, this door stop involving mounting means secured in a fixed position on the lower edge of the door. This novel door stop is affixed relatively near one long edge of the door, at a location remote from the hinge line of the door. An elongate, rigid member is operatively associated with the mounting means, with one end of the elongate, rigid member pivotally attached to the mounting means. The other end of the elongate, rigid member has an angularly-disposed component adapted to move at the behest of a user into contact with the floor. In other words, the elongate member is selectively movable between a substantially vertical storage position residing close to the door, and an active, downwardly angled position in which the other end is in contact with the floor. A bias means is preferably attached to a mid portion of the elongate, rigid member, which bias means serves to hold latter member firmly in the downwardly angled, floor-contacting relationship when it is so positioned by the user. The elongate, rigid member serves, when in the downwardly angled position, to effectively deny entry to an intruder trying to push the door open.

An aperture is utilized in one end of the elongate, rigid member at the location of the pivotal mounting, and this aperture may take the form of a generally J-shaped aperture. The configuration of this J-shaped aperture is such as to enable the elongate, rigid member to be readily and securely maintained in the storage position upon being moved by the user to such position.

A slotted receptacle may be used in conjunction with the angled end of the elongate, rigid member, with this slotted receptacle adapted to be attached to the floor in a location near the lower edge of the door.

It is therefore a principal object of this invention to provide a highly effective, low cost, one piece door stop usable in a highly effective manner on the lower portion of a door.

It is another object of this invention to provide an inexpensive yet highly effective, pivotally-mounted door stop, which the user can readily attach to the lower portion of the door in order to prevent an intruder from pushing the door open.

It is still another object to provide a one piece door stop portable enough that it may be carried in a briefcase or other luggage, then be readily mounted on the lower inside portion of a door when needed to block unauthorized entry.

BRIEF DESCRIPTION OF DRAWINGS

FIG. 2 is an exploded view, revealing the several components constituting my novel pivoted door stop, with the J-shaped aperture utilized in the elongate, rigid member being shown in considerable detail;

FIG. 3 is a side elevational view generally along the lines of FIG. 1, with the elongate, rigid member depicted in its active position, in which it blocks the door being pushed open;

FIG. 4 is a side elevational view generally relatable to FIG. 3, but here showing the elongate, rigid member in its raised, out-of-the-way storage position; and FIG. 5 is a fragmentary view to a large scale, revealing the construction of the slotted receptacle that may receive the angled lower end of the elongate, rigid member, when latter member has been moved into its active position.

DETAILED DESCRIPTION

Figure 1:
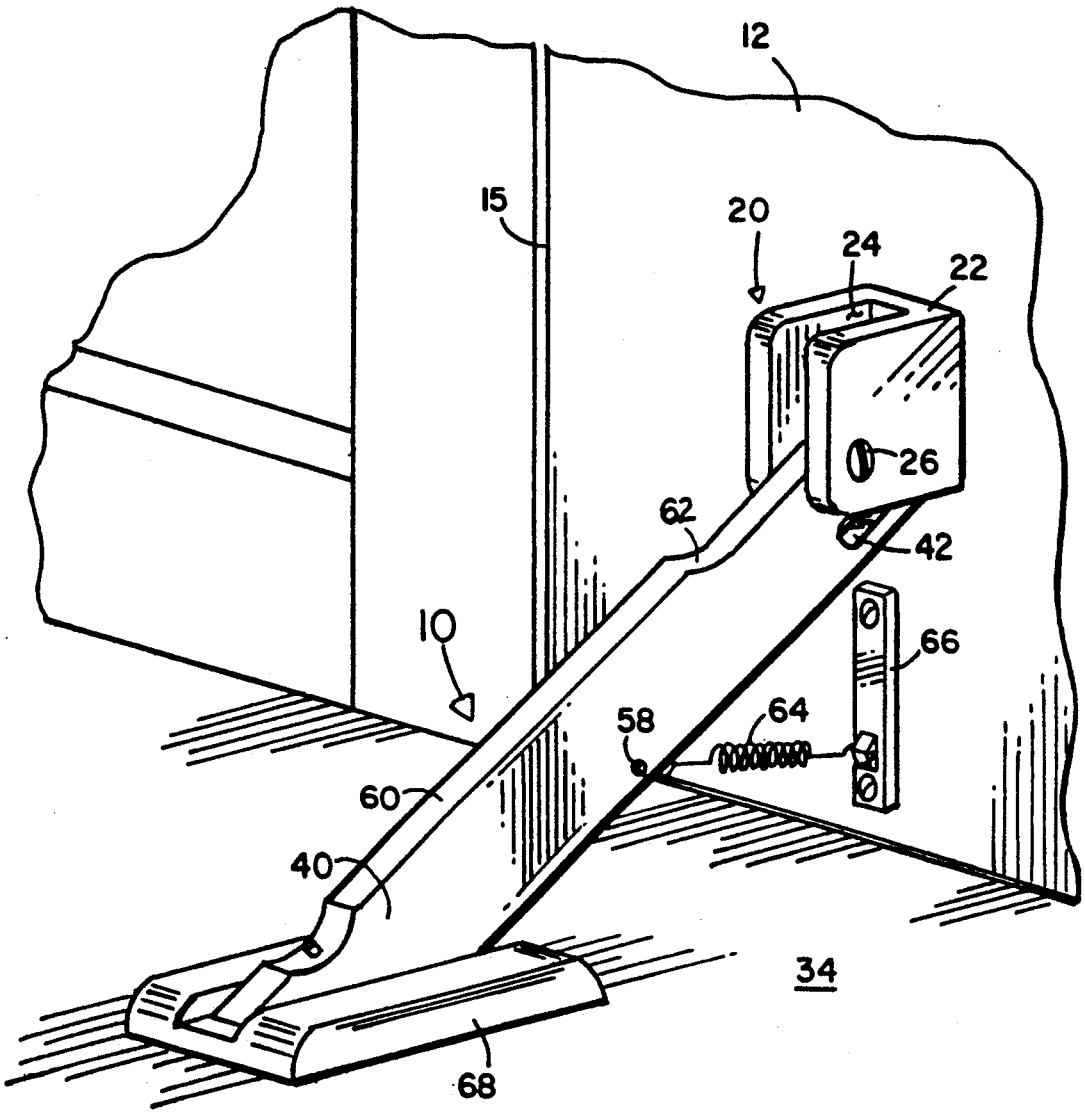
FIG. 1 is a perspective showing of a preferred embodiment of a one-piece door stop in accordance with this invention, showing the door stop in a position in which an elongate, rigid member effectively blocks an intruder from pushing the door open.

With initial reference to FIG. 1, it is to be noted that a door stop 10 in accordance with this invention is adapted for a permanent mounting on a lower edge of a door 12, and which functions in a highly effective manner to prevent an intruder from pushing the door open. My door stop is to be secured in a fixed position adjacent the lower edge of the door 12, at a location near the long vertical edge 15 of the door adjacent which the knob and latch are mounted. The other long vertical edge of the door, upon which the hinges are mounted, is not depicted in the drawings nor is it involved in this invention.

The door stop 10 comprises mounting means 20 affixed on the lower part of the door relatively near the long vertical edge 15 of the door, at a location remote from the hinge line of the door. The other part of the door stop combination is an elongate, rigid member 40, which is hingedly mounted on the mounting means 20.

The mounting means 20 comprises a generally U-shaped bracket 22, secured to the door by the use of two or more relatively short wood screws or sheet metal screws 23 (see FIGS. 2 and 4), or by double-sided tape 25 (see FIG. 3). I prefer to use a heavy duty double sided tape, which will enable the U-shaped member 22 to be mounted near the bottom of the door in what may be regarded as a permanent manner.

One end of the elongate, rigid member 40 is rotatably mounted in the central slot 24 of the U-shaped bracket 22. As is apparent from FIG. 1, but illustrated in even clearer detail in FIG. 2, this one end or upper end of the rigid member 40 is provided with a generally J-shaped aperture 42, through which a mounting screw 26 supported in the bracket 22 can be passed, so that the elongate, rigid member 40 will stay operatively attached to the bracket 22. The reason why I preferably utilize in the upper end of the rigid member 40, an aperture 42 that is J-shaped will be discussed at some length hereinafter.

As can be seen from FIG. 2, the screw 26 is sized to pass through a hole 28 that extends through both sides of the U-shaped bracket 22. Screw 26 has a limited number of threads 30 on the end opposite the head of the screw, which threads are intended to secure the screw 26 in a tight-fitting manner to the U-shaped bracket. The threads 30 may engage screw threads located on the side of the U-shaped bracket 22 opposite the head of the screw, or as an alternative, a threaded nut 32 may be utilized to secure the screw 26 in the U-shaped bracket 22; note FIG. 2. As is obvious, the screw 26 serves as a pivot pin or pivot means around which the rigid member 40 is rotatable at the behest of the user.

The opposite end of the elongate, rigid member 40, also referred to as the lower end, is provided with an angled surface 50 intended to make effective contact with the floor 34 when the user has moved the member 40 about the pivot means 26 of the bracket 22 into the deployed position illustrated in FIGS. 1 and 3. In accordance with one option I may employ, a short anti-skid member 52 is attached to the angled surface 50, to enable the rigid member 40 to make firm contact with the floor when this member has been moved to its active position. I typically use the anti-skid member 52 when a marble floor, or the like is involved.

It is to be understood that the elongate, rigid member 40 is selectively movable between a substantially vertical storage position residing close to the door 12, as depicted in FIG. 4, and the downwardly angled, active position shown in FIGS. 1 and 3, in which the angled end 50 (or member 52) of the rigid member 40 is in firm contact with the floor 34. The angled surface 50 is preferably disposed at approximately a 45° angle to the longitudinal centerline 54 of the member 40, but I am not to be limited to this precise angle.

When viewing the elongate, rigid member 40 in the active position depicted in FIGS. 1 and 3, it is to be realized that the use of the angled surface 50 on the lower end of the member 40 has the effect of making the underside or lower edge 56 of the member 40 somewhat shorter than the upper surface 60 of the member 40. Continuing with FIGS. 1 and 3, it will be noted that a small hole 58 is provided in approximately the midpoint of the member 40, near the edge of the underside or undersurface 56, to permit the attachment of one end of a bias means 64 to the member 40. The bias means 64 is preferably a tension spring, as illustrated in FIGS. 1 and 3, although in some instances, the bias means can be of non-metallic material, such as an elastic, a short, small bungee cord, or the like. The opposite end of the bias means 64 is to be attached to a small mounting plate 66, which is to be attached to the door at a location somewhat below the U-shaped mounting bracket 22, such as by the use of screws or by double sided tape.

As is obvious, the bias means 64 attached to a mid portion of the elongate, rigid member 40, serves to hold latter member firmly in the downwardly angled, active position upon the member 40 being so positioned by the user. In this position, the lowermost, angled surface 50 makes firm contact with the slotted receptacle 68, best seen in FIGS. 2 and 5, in such a manner as to firmly deny entry to an intruder endeavoring to push the door 12 open.

The previously mentioned J-shaped aperture 42, utilized in the upper end of the elongate, rigid member 40 at the location of the pivotal mounting, advantageously enables the rigid member 40 to be readily maintained in the generally vertically-disposed storage position depicted in FIG. 4, upon the member 40 being moved to that position by the user. The upper surface 60 of the member 40 is relieved or contoured at location 62, so as to avoid interference with the U-shaped bracket 22 when the rigid member 40 is in the raised or inactive position.

From FIG. 2 it can be seen that the J-shaped aperture 42 has a long slot or leg 44 that is essentially parallel to the longitudinal centerline 54 of the elongate, rigid member 40. The J-shaped aperture also has a short slot or leg 46 that is parallel to the long slot or leg 44, with the two slots or legs being joined by a short leg 48 disposed at a remote location with respect to the angled surface 50, and perpendicular to the longitudinal centerline 54.

It is to be understood that when the rigid, elongate member 40 is in the active, downwardly angled position depicted in FIG. 1, the screw 26 serving as the mounting pin resides in the short slot or leg 46 of the J-shaped aperture, whereas when the elongate member 40 is moved toward the upwardly-extending storage position depicted in FIG. 4, the screw or pivot pin 26 moves across short leg 48 to the long leg 44, and then slides along the length of the long leg or slot 44, coming to rest in the part of the slot 44 at a location closest to the angled surface 50.

As a result of this arrangement, and the consequential length of the member 40 extending below the pivot pin 26, the member 40 may be regarded as locked in the upper, inactive position. As is obvious, to deploy the member 40 in the door-blocking attitude, it is only necessary for the user to lift the member 40 upwardly for a distance corresponding to the length of the long leg 44, so that the member 40 can then pivot away from the door, down into the door-blocking relationship depicted in FIGS. 1 and 3. The spring 64 (or a non-metallic bias means) then serves to hold the angled surface 50 in firm contact with the slotted receptacle 68, or, alternatively, hold the anti-skid member 52 in firm contact with the floor in the event the slotted receptacle is not used.

With regard to FIGS. 3 and 4, it is to be noted that I here reveal an embodiment in which the member 66 is not a member separate from the U-shaped bracket 22, but rather, in this instance I show that one-piece construction may be utilized. In FIG. 3 I show the member 66 and U-shaped bracket held against the door by the use of double-sided tape 25, whereas in FIG. 4 I reveal the member 66 and U-shaped bracket secured to the door by a plurality of screws 23.

With regard to the slotted receptacle 68, it is to be understood that this receptacle is adapted to be attached to the floor in an appropriate location near the lower edge of the door, when the door is in a closed position, such as by the use of screws or double-sided tape. The receptacle 68 is of course employed when no anti-skid member 52 is being utilized on the angled surface 50 of the elongate, rigid member 40.

The receptacle 68, visible in FIGS. 1 and 2, is shown in cross-section in FIG. 5 to reveal a central aperture 72. A short pin 70, to be seen in FIG. 2, is slidably mounted in the angled end 50 of the elongate, rigid member 40 in order that the angled end can be secured in a non-slip manner to the slotted receptacle 68. That this may be accomplished, when the angled end 50 is resting in the central slot of the receptacle 68, the user pushes down on the pin 70, to cause the opposite end of this pin to enter the central aperture 72.

When the angled end of the rigid member 40 is residing in operative contact with the receptacle 68, and the pin 70 is engaging the central aperture 72 of the receptacle, these members are regarded as being in a locked relationship. When in this locked relationship, any dislodgment of the angled end of the member 40 from the receptacle 68 is strongly resisted. Tests have shown that a would-be intruder, attempting to slide a tool under the door in order to dislodge the elongate, rigid member 40 from engagement with the receptacle 68 would have great difficulty in bringing about rotation of the elongate, rigid member 40 away from the operative position shown in FIG. 1.

As is obvious, I construct the pin 70 to have sufficient length that an uppermost portion of the pin is available to be engaged by the thumb and forefinger of the user, at the time the pin is to be retracted and the rigid member 40 removed from engagement with the receptacle 68, in order that the door may be opened. I may utilize a small spring for preventing the slidable pin 70 from becoming dislodged from the angled end 50 of the elongate, rigid member 40.

Inasmuch as when the receptacle 68 is utilized, it becomes, for all intents and purposes, a part of the floor, I regard the lower end 50 of the elongate member 40 to be in contact with the floor when the member 40 is in the door-blocking attitude, even though at such time the lower end of the member 40 is actually in contact with the receptacle 68.

I claim:

1. A door stop adapted for a mounting adjacent a lower edge of a door at a location remote from the hinge, said door stop functioning to prevent an intruder from pushing the door open, said door stop comprising mounting means adapted to be secured in a fixed position adjacent the lower edge of the door, and an elongate, rigid member operatively associated with said mounting means, one end of said elongate, rigid member having an aperture, enabling it to be pivotally mounted to said mounting means, and the other end of said elongate, rigid member having a component adapted to move into contact with the floor at the behest of a user, said elongate, rigid member being selectively movable between a raised, substantially vertical storage position residing close to the door, and an active, downwardly angled position in which said other end is in firm contact with the floor, a receptacle being used in conjunction with said other end of said elongate, rigid member, said receptacle adapted to be attached to the floor in a location near the lower edge of the door, to removably receive said other end of said elongate, rigid member, an aperture located in a central portion of said receptacle, and a slidable pin is located in said other end of said elongate rigid member, said pin being slidable into contact with said aperture when the user wishes to cause the elongate, rigid member to be in a locked relationship with said receptacle.

2. The door stop as recited in claim 1 in which said slidable pin is configured for ready removal from contact with said aperture when the elongate, rigid member is to be removed from contact with said receptacle.

3. The door stop as recited in claim 1 in which a bias means is attached to a mid-portion of said elongate, rigid member, serving to hold the latter member in the downwardly angled, floor-contacting position upon the elongate, rigid member being so positioned by the user, said elongate, rigid member serving when in the downwardly angled position to deny an intruder entry through the door.

4. The door stop as recited in claim 3 in which said bias means attached to said elongate rigid member is a tension spring, with the other end of said spring being attached to mounting means on the door.

5. The door stop as recited in claim 1 in which said mounting means has a flat rear surface for receiving a short length of double-sided tape, such double-sided tape being usable for securing said mounting means to the door.

6. A door stop adapted for a mounting adjacent a lower edge of a door at a location remote from the hinge, said door stop functioning to prevent an intruder from pushing the door open, said door stop comprising mounting means adapted to be secured in a fixed position adjacent the lower edge of the door, and an elongate, rigid member operatively associated with said mounting means, one end of said elongate, rigid member having an aperture, enabling it to be pivotally mounted to said mounting means, and the other end of said elongate, rigid member having a component adapted to move into contact with the floor at the behest of a user, said elongate, rigid member being selectively movable between a raised, substantially vertical storage position residing close to the door, and an active, downwardly angled position in which said other end is in firm contact with the floor, said aperture in said elongate, rigid member being in the form of a generally J-shaped aperture, said J-shaped aperture enabling said elongate, rigid member to be readily maintained in the storage position upon being moved away from floor contact, to a substantially vertical position close to the door, the use of said J-shaped aperture enabling said elongate, rigid member to be released from the storage position by lifting it upwardly.

7. The door stop as recited in claim 6 in which said mounting means has a flat rear surface to which adhesive can be applied, such adhesive to be sued for securing said mounting means to the door.

8. A door stop adapted for a mounting adjacent a lower edge of a door at a location remote from the hinge, said door stop functioning to prevent an intruder from pushing the door open, said door stop comprising in combination, mounting means adapted to be secured in a fixed position adjacent the lower edge of the door, an elongate, rigid member operatively associated with said mounting means, and a member-receiving floor receptacle adapted to be attached to the floor in a location near the lower edge of the door, one end of said elongate, rigid member having an aperture, enabling it to be pivotally mounted to said mounting means, and the other end of said elongate, rigid member having a component adapted to move into contact with said floor receptacle at the behest of a user, said elongate, rigid member being selectively movable between a raised, substantially vertical storage position residing close to the door, and an active, downwardly angled position in which said other end is in firm contact with said floor receptacle, and locking means for enabling the user to lock said other end of said elongate, rigid member in firm contact with said floor receptacle.

9. The door stop adapted for a mounting adjacent a lower edge of a door at a location remote from the hinge as recited in claim 8 in which said elongate, rigid member contains an aperture of J-shaped configuration, said J-shaped aperture enabling said elongate, rigid member to be readily maintained in the storage position upon being moved away from floor contact, to a substantially vertical position close to the door, the use of said J-shaped aperture enabling said elongate, rigid member to be released from the storage position by lifting it upwardly.

10. The door stop adapted for mounting adjacent a lower edge of a door at a location remote from the hinge as recited in claim 8 in which a bias means is attached to a mid portion of said elongate, rigid member, serving to hold latter member in the downwardly angled, floor-contacting position upon the elongate, rigid member being so positioned by the user, said elongate, rigid member serving when in the downwardly angled position to deny an intruder entry through the door.

* * * * *